United States Patent [19]

Kimura et al.

[11] Patent Number: 4,616,924

[45] Date of Patent: Oct. 14, 1986

[54] CLEANING DEVICE FOR USE WITH TRANSFER TYPE ELECTROSTATIC COPYING MACHINES

[75] Inventors: Hiroshi Kimura, Habikino; Masahiko Hisajima, Osaka; Kiyoshi Shibata, Osaka; Kiyoshi Morimoto, Osaka, all of Japan

[73] Assignee: Mita Kogyo Kabushiki Kaisha, Japan

[21] Appl. No.: 594,624

[22] Filed: Mar. 29, 1984

[30] Foreign Application Priority Data

Apr. 1, 1983 [JP] Japan ..... 58-58299

[51] Int. Cl.[4] ..... G03G 21/00

[52] U.S. Cl. ..... 355/15; 118/652; 15/256.51

[58] Field of Search ..... 355/15; 118/652; 15/1.5 R, 256.5, 256.51, 256.52

[56] References Cited

U.S. PATENT DOCUMENTS 3,552,850 1/1971 Royka et al. ..... 355/15
3,570,224 3/1971 Clemens ..... 355/15 X
4,349,270 9/1982 Wada et al. ..... 355/15
4,465,362 8/1984 Tohma et al. ..... 355/15

FOREIGN PATENT DOCUMENTS 55-53384 4/1980 Japan ..... 355/15

*Primary Examiner*—Arthur T. Grimley
*Assistant Examiner*—J. Pendegrass
*Attorney, Agent, or Firm*—Beveridge, De Grandi & Weilacher

[57] ABSTRACT

A cleaning device for use with transfer type electrostatic copying machines wherein a wiping assembly disposed upstream of a charging-purpose corona discharger along the direction of travel of a photoreceptor is brought into slide contact with the photoreceptor during exposure to intercept residual toner particles on the photoreceptor. The wiping assembly comprises upstream and downstream members adapted to be brought into slide contact with the photoreceptor, and a pressure setting assembly for applying individual preset pressures to the two members, the arrangement being such that some of the residual toner particles are intercepted by the upstream member and then the remainder are intercepted by the downstream member.

4 Claims, 7 Drawing Figures

CLEANING DEVICE FOR USE WITH TRANSFER TYPE ELECTROSTATIC COPYING MACHINES

BACKGROUND OF THE INVENTION

The present invention relates to a cleaning device for use with transfer type electrostatic copying machines, and more particularly, to a cleaning device for use with transfer type electrostatic copying machines, wherein a wiping assembly is brought into slide contact with a photoreceptor during exposure to intercept residual toner particles on the photoreceptor.

The basic arrangement of transfer type electrostatic copying machines for forming a latent electrostatic image on the photoreceptor by exposure of a document, visualizing the latent electrostatic image by a toner, and transferring the toner image onto copying paper to provide a document image, has heretofore been well known, and today these types of copying machines are in wide use.

In such transfer type of electrostatic copying machine, since it takes time for the discharge by the corona discharger to rise and fall, the region of discharge onto the photoreceptor by the corona discharger prior to exposure is so arranged as to extend longer in the direction of travel of the photoreceptor than the exposure region. Since the discharge region is thus longer than the exposure region, the discharged region will include some unexposed portion, or untransferring portion in which a substantial amount of toner remains. Further, in cases where a large-sized document is copied using a small-sized copying paper sheet, the toner images will include some portion untransferred to the copying paper, or untransferred portion in which a substantial amount of toner remains. Thus, prior to the next copying operation, these residual toner particles should be removed to provide a copy having a clear reproduced image. To this end, a cleaning device is installed between the transfer region from which the toner image is transferred to the copying paper, and the charging region where the photoreceptor is uniformly charged by the corona discharger prior to exposure, so that the residual toner particles remaining subsequent to exposure are removed from the photoreceptor by the cleaning device.

Such cleaning devices which are well known include:

(1) A brush cleaning device (U.S. Pat. No. 2,832,977) of the type comprising one or more brushes whereby residual toner particles are separated from the photoreceptor and putting them into an air stream being discharged through a filter device:

(2) A web cleaning device (U.S. Pat. No. 3,186,838) of the type comprising a web of fibrous material adapted to pass over the photoreceptor surface to remove residual toner particles on the photoreceptor; and (3) A blade cleaning device (U.S. Pat. No. 3,552,850) of the type comprising a pivotal head, a blade member fixed to said head, said blade member being adapted to be flexibly engaged with the photoreceptor surface to intercept residual toner particles, and a cam moving with the photoreceptor and adapted to keep the blade member away from the photoreceptor for a predetermined time to allow the intercepted residual toner particles to move together with the photoreceptor to the developing device, so that they can be reused.

Of these cleaning devices, the first two present problems that they occupy a large space, that they require a driving device, and that they are uneconomical because they cannot reuse residual toner. The last cleaning device eliminates these problems, and the corresponding U.S. Patent discloses that a plurality of blade members are arranged to intervals in the direction of travel of the photoreceptor.

However, U.S. Pat. No. 3,552,850 makes no disclosure whatsoever of setting individual slide contact pressures with which the blade members are to be pressed against the photoreceptor. As considered from the statement contained therein to the effect that different materials are used for different blade members to thereby ensure complete removal of the residual toner, it seems that the slide contact pressures for all blade members with respect to the photoreceptor are set so that they are the same.

With the cleaning device of the aforesaid arrangement, since residual toner particles are intercepted by the plurality of blade members, the intercepting effect is high, but the amounts intercepted by the blade members will differ and the blade members have to be made of different materials. The intercepting effect cannot be continuously controlled by using different materials, and it is very difficult to select optimum materials in accordance with the amounts to be intercepted. Thus, only rough selection would be possible. Therefore, the residual-toner intercepting effect would be insufficient or the slide contact pressures on the photoreceptor would be too high, causing premature wear of the photoreceptor.

SUMMARY OF THE INVENTION

An object of this invention is to provide a cleaning device capable of eliminating the problems described above.

Another object is to completely intercept the residual toner on the photoreceptor.

A further object is to maintain the slide contact pressures of the cleaning device on the photoreceptor surface at proper values to thereby reduce surface wear and damage to the photoreceptor.

This invention comprises a photoreceptor adapted to travel in one direction and serving for formation of a latent electrostatic image, for visualization into a toner image, and for transfer of the toner image to copying paper, a charging-purpose corona discharger for charging the photoreceptor surface prior to exposure of a document, an upstream member adapted to be brought into slide contact with the photoreceptor to interecept residual toner particles remaining on the photoreceptor upon completion of transfer, a downstream member adapted to be brought into slide contact with the photoreceptor to thereby intercept the toner particles which were not intercepted by the upstream member, and a pressure setting assembly for imparting preset pressures to the upstream and downstream members. The upstream and downstream members may be made of the same material or different materials and slide contact pressures will be set according to the kind of material and the stiffness of the two members.

DESCRIPTION OF THE PREFERRED EMBODIMENTS

Figure 1:
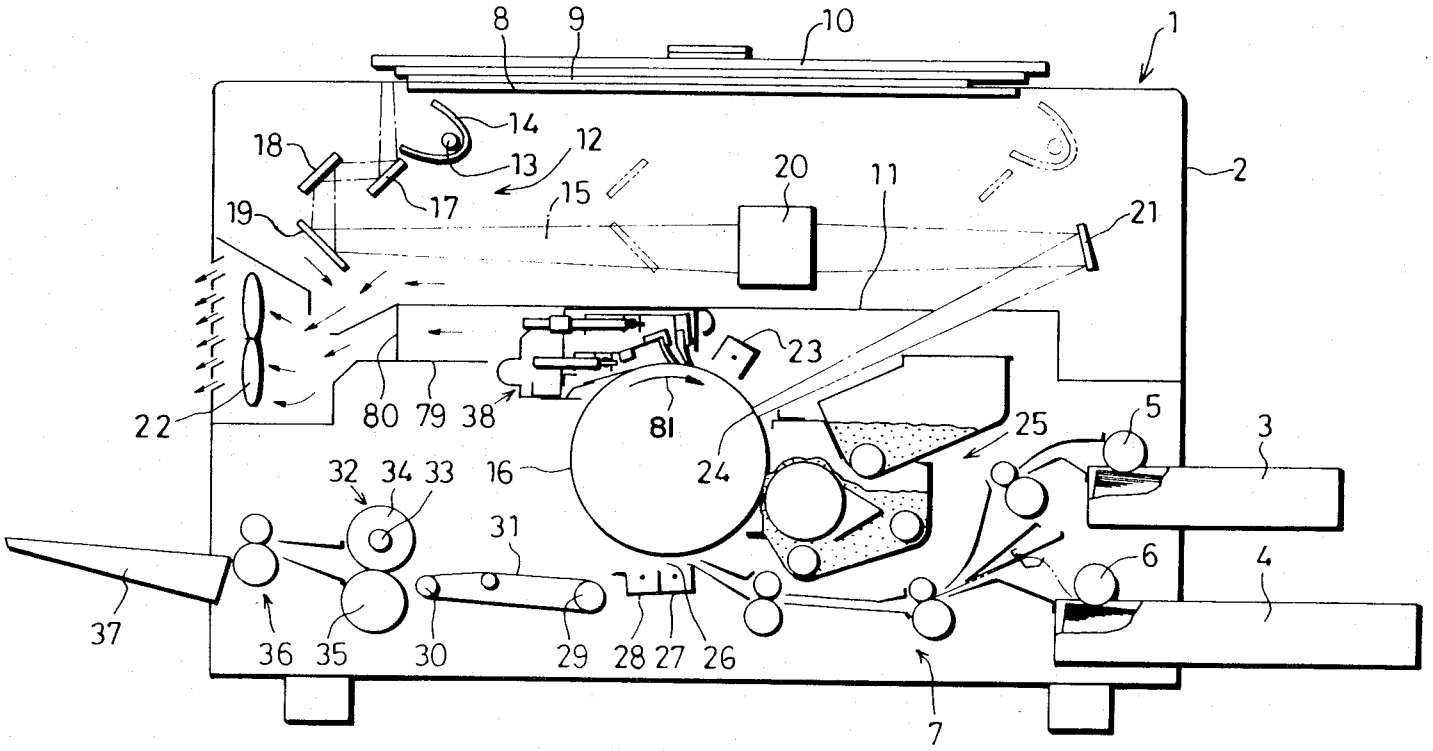
FIG. 1 is a schematic view of a transfer type electrostatic copying machine.

FIG. 1 is a vertical sectional view of a typical transfer type electrostatic copying machine.

Copying paper sheets contained in paper feed cassettes 3 and 4 mounted on the machine frame 2 of the transfer type electrostatic copying machine 1 are selectively fed one by one by paper feed rollers 5 and 6 and conveyed by a conveying device 7 having three pairs of rollers.

Placed on a horizontal transparent plate 8 mounted on top of the machine frame 2 is a document 9, which is pressed into intimate contact with the transparent plate 8 by a keep plate 10. The interior of the machine frame 2 is divided by a partition plate 11, and the upper compartment contains an optical device 12. The optical device 12 comprises an exposure lamp 13, a reflecting mirror 14 for efficiently reflecting the light from the exposure lamp 13 to the document 9, and reflecting mirrors 17, 18, and 19, a lens 20, and a reflecting mirror 21, whereby a light image of the document 9 is guided along an optical path 15 to be formed on a photoreceptor drum 16. Disposed adjacent the left-hand end of the interior of the machine frame 2 in FIG. 1 is a cooling fan 22 for cooling the optical device 12.

In exposure, the optical device 12, excluding the lens 20 and reflecting mirror 21, travels for exposure from left to right in the machine frame, as shown in phantom lines. Upon completion of exposure, the optical device 12, excluding the lens 20 and reflecting mirror 21, travels in the opposite direction back to the stop position shown in solid lines.

The surface of the photoreceptor 16 is charged by a corona discharger 23. In an exposure region 24, the document image from the optical device 12 is formed on the thus charged photoreceptor 16, whereby a latent electrostatic image is formed. This latent electrostatic image is visualized into a toner image by a developing device 25. This toner image is transferred by a corona discharger 27 to a copying paper sheet conveyed by the conveying device 7 in a transfer region. The copying paper sheet having the toner image transferred thereto is positively peeled off the photoreceptor 16 by the action of a charge remover 28. The copying paper sheet thus peeled is conveyed to a heat fixing device 32 by an endless conveyor belt 31 driven by belt rollers 29 and 30. The heat fixing device 31 comprises a hot roller 34 containing a heater 33, and a pressure roller 35 urged against the hot roller 34. When the copying paper sheet is passed between the hot and pressure rollers 34 and 35, the toner on the copying paper sheet is melted and the document image is thereby fixed. The copying paper sheet undergoing the fixing step is then delivered to a tray 37 by a pair of paper delivery rollers 36.

Subsequent to the transfer step, the photoreceptor 16 is cleaned by a cleaning device 38 according to the present invention.

Disposed in a region extending from the left-hand end of said cleaning device 38 to the cooling fan 22 is a partition plate 79, and a filter 80 for recovering toner particles scattered from the cleaning device, as will be later described, is installed between this partition plate 79 and the aforesaid partition plate 11.

Figure 2:
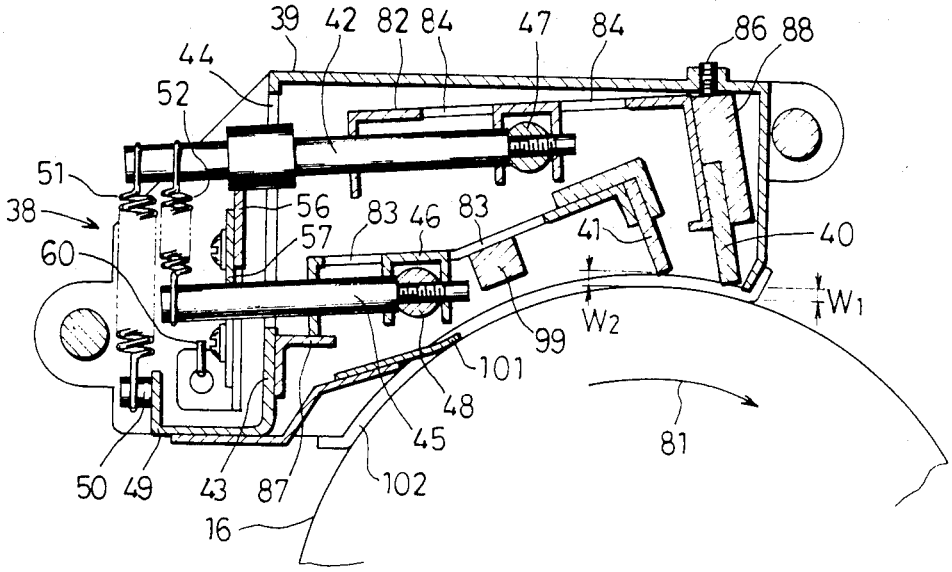
FIGS. 2 and 3 are enlarged vertical sectional views of a cleaning device, FIG. 2 showing the non-operation state and FIG. 3 the cleaning operation state.
Figure 3:
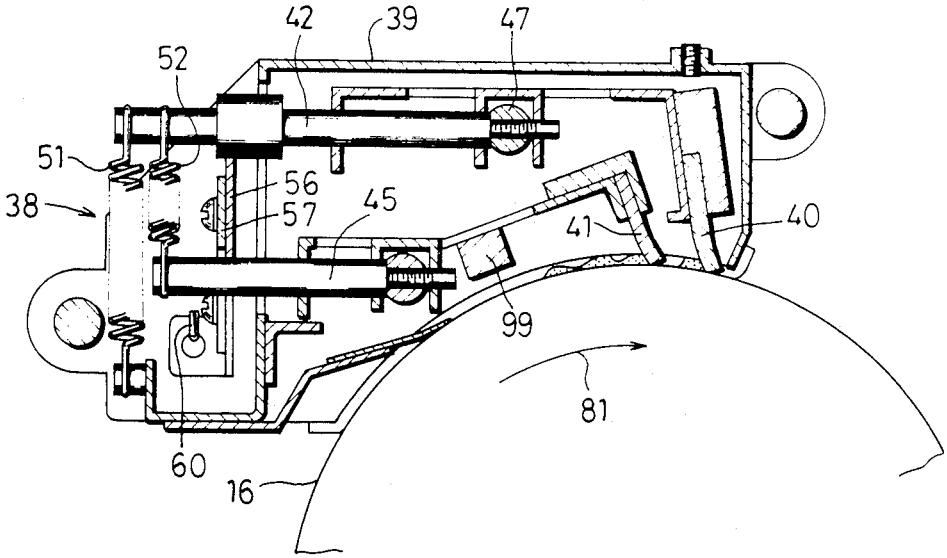

FIGS. 2 and 3 are sectional views showing the details of the cleaning device 38. The cleaning device 38 according to the invention is positioned in a region extending from said transfer region 26 to said charging-purpose corona discharger 23 along the direction of travel of the photoreceptor 16 indicated by an arrow 81. The casing 39 of the cleaning device 38 supports a downstream member 40 and an upstream member 41 so that they can be moved toward and away from the photoreceptor 16. The downstream member 40 is fixedly installed through a support member 82 on one end of a swing lever 42 horizontally extending substantially at right angles to the axis of the photoreceptor drum. The other end of the swing lever 42 extends through a vertically extending elongated opening 44 formed in the rear plate 43 of the casing 39. On the other hand, the upstream member 41 is fixedly installed through a support member 46 on one end of a swing lever 45 disposed substantially parallel to the swing lever 42. The upstream and downstream members 41 and 40 are made of such a material as will positively intercept residual toner particles and rarely damage the photoreceptor 16, and in the illustrated preferred embodiment, it is so arranged that the thickness of the upstream member 41 is made less than that of the downstream member 40 to give superior flexibility to the upstream member 41 and that flexibility can be easily set to desired values by exchanging the members for ones having different thicknesses.

The support members 46 and 82 are formed with throughgoing holes 83 and 84, respectively. The support member 46 is provided with magnetic attraction means 99 for protecting the photoreceptor 16 from being damaged by the carrier particles contained in the residual toner when the latter is intercepted by the downstream and uptream members 40 and 41. The magnetic attraction means 99 is in the form of a permanent magnet or the like, and it suffices for the purpose to provide such means to at least one of the support members 46 and 82, but the provision of it to the support member 46, as described above, is preferable since this makes it possible to attract the carrier particles before the residual toner particles are intercepted by the upstream member. Further, the casing 39 is provided with shield members 101, 102, and 103 (see FIG. 6) for maintaining the interior of the casing 39 at a negative pressure when the downstream member 40 is in slide contact with the photoreceptor drum, as will be later described. The other end of the swing lever 45 extends through an elongated opening 44, as in the case of the swing lever 42. The swing levers 42 and 45 are pivotally supported by rotary shafts 47 and 48, substantially at the middle of each rotary shaft, which are parallel to the axis of the photoreceptor drum. A spring 51 is connected at its one end to a projection 50 on the lateral plate 49 of the casing 39 and at the other end to the end of the swing lever 42 extending beyond the casing 39. Disposed adjacent this spring 51 is a spring 52 connected between the swing levers 42 and 45. The portion of the swing lever 42 extending through the elongated opening 44 is increased in diameter. Therefore, the downstream member 40 is urged by the spring 51 to move away from the photoreceptor 16, whereas the upstream member 41 is urged by the spring 52 to move toward the photoreceptor 16.

Figure 4:
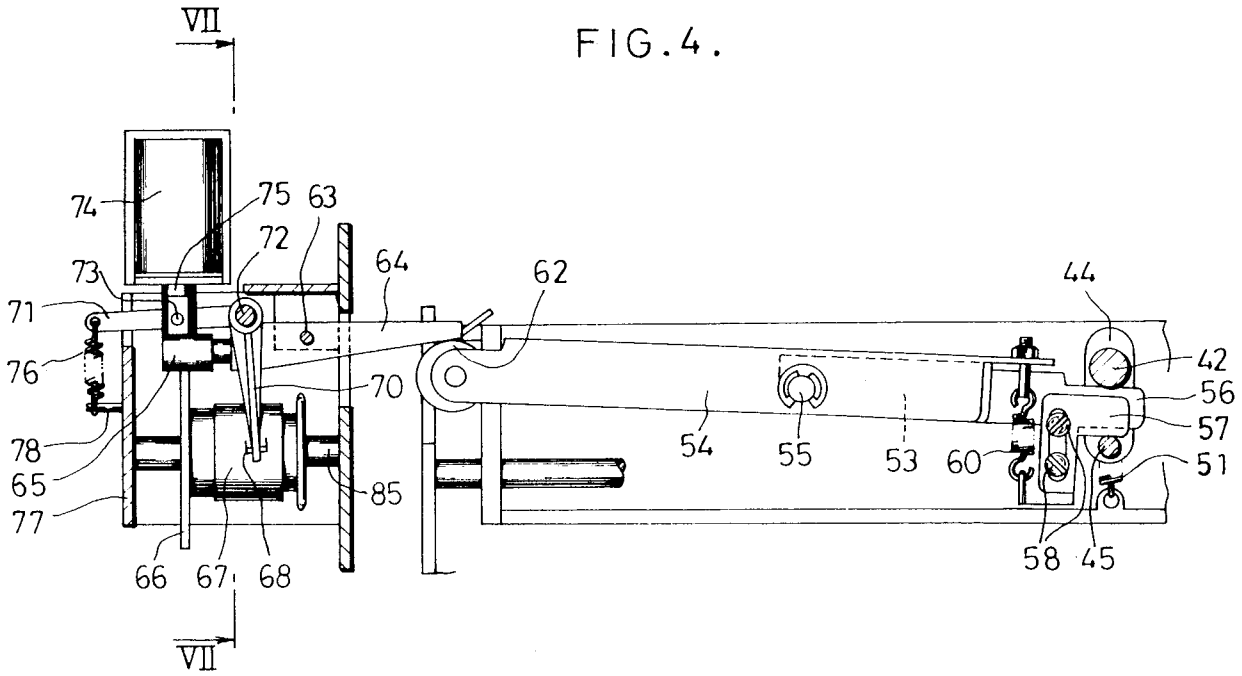
FIGS. 4 and 5 are enlarged rear views showing the cleaning device, FIG. 4 showing the non-operation state and FIG. 5 the operation state of the cleaning device.
Figure 5:
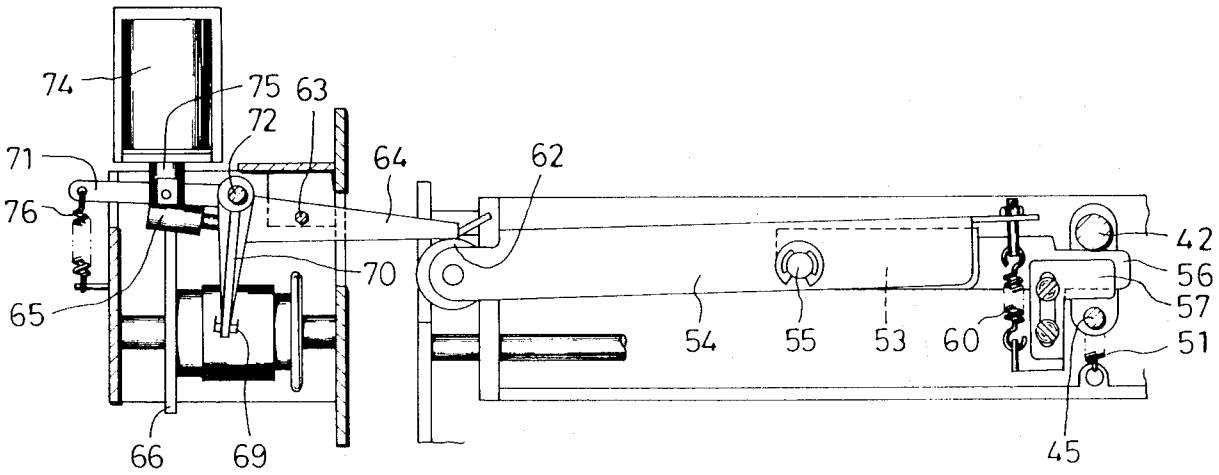
Figure 6:
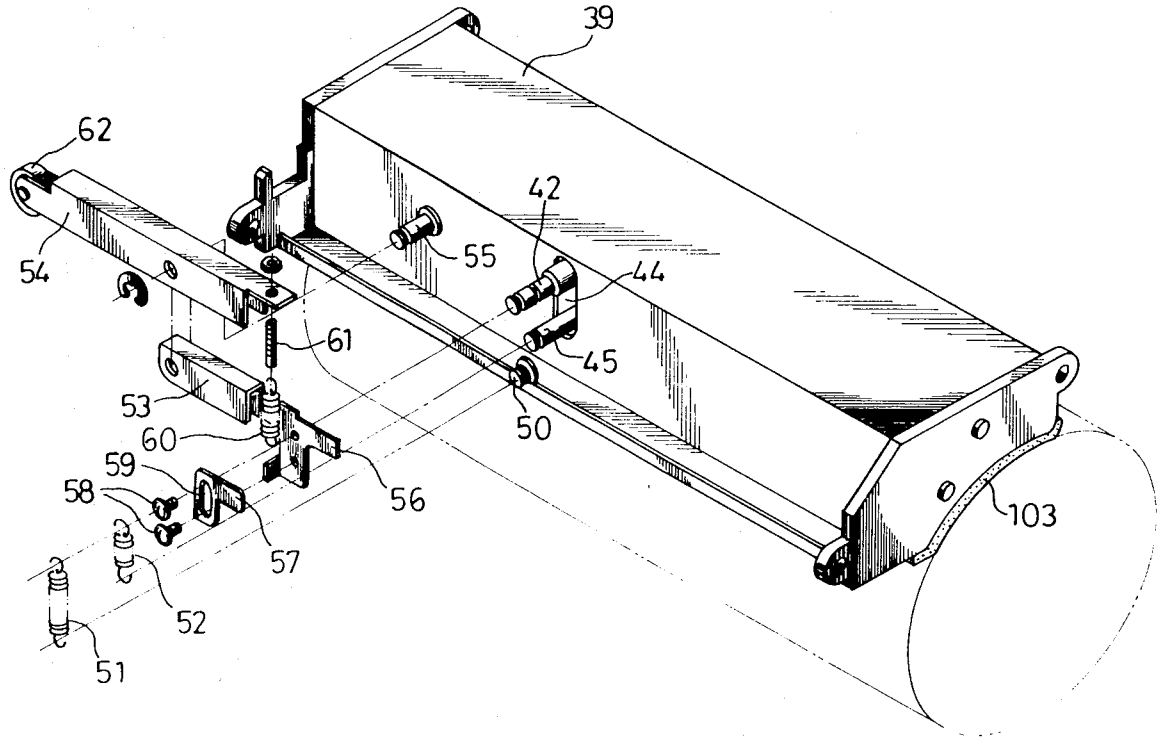
FIG. 6 is an exploded perspective view of the principal portion of the cleaning device.
Figure 7:
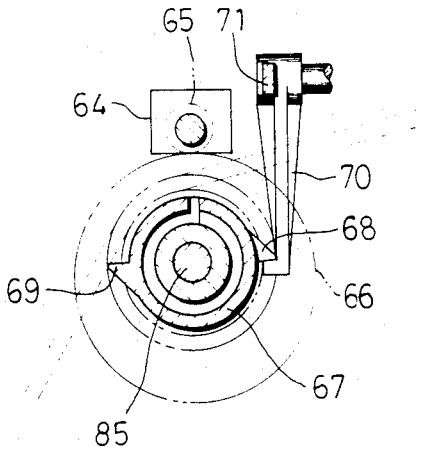
FIG. 7 is a sectional view taken along the line VII—VII of FIG. 4.

FIGS. 4 and 5 are views taken from behind the cleaning device 38 shown in FIGS. 2 and 3, respectively. FIG. 6 is an exploded perspective view of the principal portion of FIG. 4, FIG. 7 is a sectional view taken along the line VII—VII of FIG. 4. Disposed behind and spaced apart from the rear plate 43 of the casing 39 are first and second arms 53 and 54 which are pivotally supported on a pin 55. The second arm 54 has its major portion made in the form of a frame which opens downward, as shown in FIG. 6, while the first arm 53 is made in the form of a frame which likewise opens downward with a suitable size to be received in the second arm 54. The second arm 54 extends (in the horizontal direction as viewed in FIG. 4) along half the length of the casing 39, while the first arm 53 extends from the pin 55 to the swing levers 42 and 45. A control member 57 is attached to the end 56 of the first arm 53 by screws 58. The control member 57, as shown in FIG. 4, is adapted to abut against the swing lever 45 to control the amount of displacement of the swing lever 45 and also the amount of displacement of the upstream member 41 fixed to the swing lever 45. The control member 57 has a vertically extending elongated opening 59, whereby its attachment to the first arm 53 can be adjusted. A spring 60 is connected at its one end to the first arm 53 and at the other end to the end of a screw member 61 attached to the second arm 54. The end of the second arm 54 rotatably supports a roller 62. A swing arm 64 turntable around the axis of a pin 63 abuts at its end against the roller 62. The other end of the swing arm 64 is provided with a follower 65 associated with a cam 66. A ratchet wheel 67 integral with the cam 66 has first and second teeth 68 and 69, as shown in FIG. 7, and is adapted to be rotated with power from an unillustrated driving source. The cam 66 has large- and small-diametered camming surfaces. An engaging member 70 adapted to be engaged with and disengaged from the first and second teeth 68 and 69 is angularly displaceable together with a connecting member 71 integral therewith around the axis of a shaft 72. The connecting member 71 is connected at its intermediate portion to a plunger 75 for a solenoid 74 by a pin 73. The free end of the connecting member 71 is connected to one end of a spring 76. The other end of the spring 76 is connected to a projection 78 on a lateral wall 77.

In this embodiment, the photoreceptor drum 16, cleaning device 38, and developing device 25 are formed into a unit which can be extracted at right angles to the paper surface of FIG. 1, and the portion to the right of the roller 62 shown in FIG. 4 is displaceable to the right, it being so arranged that transmission of power from the machine is effected by engagement between the roller 62 and the swing arm 64.

FIGS. 2, 4, and 7 show a non-cleaning state during non-exposure. Referring to these figures, when the solenoid 74 is in the deenergized state, the engaging member 70 is engaged with the first tooth 68 by the force of the spring 76, while the follower 65 is contacted with the small-diametered camming surface of the cam 66 by the force of the spring 51 and the portion of the swing arm 64 associated with the roller 62 with respect to the pin 63 is upwardly inclined.

On the other hand, as shown in FIG. 2, the swing lever 42 is downwardly inclined around the axis of the rotary shaft 47 by the force of the spring 51, with the large-diametered portion of the swing lever 42 pushing down the end 56 of the first arm 53 and with the control member 57 pushing down the lever 45. With the swing lever 42 in this position, a clearance W1 is formed between the downstream member 40 and the photoreceptor 16. Further, with the swing lever 45 in this position, a clearance W2 is formed between the upstream member 41 and the photoreceptor 16. The clearance W1 defined between the downstream member 40 and the photoreceptor 16 is adjustable by an adjusting member 86 installed in the portion of the casing 39 above the downstream member 40, said adjusting member abutting against the upper portion of a holder member 88 holding the downstream member between it and the support member 82. The clearance W2 defined between the upstream member 41 and the photoreceptor 16 is controlled by a control plate 87 installed on the rear plate 43 of the casing 39, said control plate being contacted by the downwardly extending portion, adjacent the rear plate 43, of the support member 46 supporting the upstream member 41. The end 56 of the first arm 53 is downwardly inclined by the large-diametered portion of the swing lever 42, while the portion of the swing arm 64 associated with the roller 62 is upwardly inclined by the spring 60 and second arm 54, as described above.

FIGS. 3 and 5 show the state established during exposure, i.e., cleaning. During cleaning, the solenoid 74 is energized, whereby the plunger 75 is upwardly moved. As a result, the connecting member 71 pinned to the plunger 75 is angularly displaced around the shaft 72 against the force of the spring 76 and the engaging member 70 integral with the connecting member 71 is disengaged from the first tooth 68. Thus, the ratchet wheel 67 is turned through 180° in the clockwise direction as viewed in FIG. 7 and it engages the second tooth 69. As a result of this 180° turning, the follower 65 abuts against the large-diametered portion of the cam 66, and the swing arm 64 is angularly displaced around the axis of the pin 63 to push down the roller 62 of the second arm 54. Thus, the second arm 54 is angularly displaced around the axis of the pin 55, and the first arm 53 connected to the second arm 54 by the spring 60 is upwardly displaced. The upward displacement of the first arm 53 causes the end 56 of the first arm 53 to push up the large-diametered portion of the swing lever 42 against the force of the spring 51 to angularly displace the swing lever 42 around the axis of the rotary shaft 47, whereby the downstream member 40 is brought into slide contact with the surface of the photoreceptor 16. The pushing-up of the swing lever 42 causes the pushing-up of the swing lever 45 through the spring 52, whereby the upstream member 41 is brought into slide contact with the surface of the photoreceptor 16.

In addition, the control member 57 is upwardly displaced by the force of the spring 52 until the upstream member 41 abuts against the photoreceptor 16, but after the upstream member 41 abuts against the photoreceptor 16, the swing lever 45 is separated from the control member 57. The toner particles which remain after the transfer step first come in contact with the shield member 101, but the shield member itself is considerably soft, allowing residual toner particles to pass through the shield member 101. The carrier particles are attracted by the magnetic attraction means 99, while some of the toner alone is intercepted under the slide contact pressure on the upstream member 41 exerted by the spring 52.

The toner particles which were not intercepted by the upstream member 41 are positively wiped from the photoreceptor 16 and intercepted by the downstream member 40 having a higher slide contact pressure than the upstream member 41.

According to the cleaning device of the invention, the downstream and upstream members 40 and 41 are held in slide contact with the photoreceptor 16 during exposure. The slide contact pressure of the downstream member 40 on the photoreceptor 16 is controlled by the spring 60, while the slide contact pressure of the upstream member 41 on the photoreceptor 16 is controlled by the spring 52. Thus, in the cleaning device of the invention, the slide contact pressures of the two members 40 and 41 on the photoreceptor can be separately set. In addition, by adjusting the forces of the springs 52 and 60, it is possible to adjust the slide contact pressures of the upstream and downstream members 41 and 40 on the photoreceptor 16. Further, the downstream and upstream members 40 and 41 are turnably installed on separate rotary shafts 47 and 48 and are moved in operative association with each other by a single input from the drive source in the rear portion of the machine frame to come in and out of contact with the photoreceptor 16. Further, their slide contact pressures on the photoreceptor 16 are adjustable. However, it is also possible to arrange the two members 40 and 41 so that said adjustment may be made by using different drive sources.

When the cleaning is completed, the solenoid 74 is deenergized and the connecting member 71 is turned around the axis of the shaft 72 by the force of the spring 76, so that the connecting member 70 integral with the connecting member 71 is also turned to be disengaged from the second tooth 69. As a result, the ratchet wheel 67 is rotated through 180° and the member 70 engages the first tooth 68. The result of this rotation is that the follower 65 contacts the small-diametered camming surface of the cam 66, with the swing arm 64 being upwardly displaced, and the state shown in FIGS. 2, 4, and 7 is reestablished. That is, the swing lever 42 is downwardly displaced around the axis of the rotary shaft 47 by the force of the spring 51, and the large-diametered portion of the swing lever 42 pushes down the end 56 of the first arm 53. Thus, the control member 57 pushes down the swing lever 45. The downward displacement of the swing lever 42 results in the reformation of the clearance W1 between the downstream member 40 and the photoreceptor 16, and the clearance W2 is also formed between the upstream member 41 and the photoreceptor 16 as a result of the swing lever 45 being pushed down. On the other hand, when the end 56 of the first arm 53 is pushed down by the large-diametered portion of the swing lever 42, the second arm 54 cooperates with the spring 60 to exert a force by which the swing arm 64 is turned counterclockwise around the axis of the pin 63, urging the follower 65 against the cam 66.

When the downstream and upstream members 40 and 41 are moved away from the photoreceptor 16, the residual toner intercepted is brought to the developing device 25 shown in FIG. 1 and recovered by the magnetic brush of the developing device 25. This arrangement in which the toner intercepted by the downstream and upstream members 40 and 41 of the cleaning device 38 is recovered at the developing device, saves the need to store the toner intercepted by the downstream and upstream members, so that the construction of the machine is simplified.

Further, according to the cleaning device of the invention, when the downstream and upstream members 40 and 41 are in slide contact with the photoreceptor 16, a negative pressure is produced in the casing 39 by the action of the cooling fan 22 shown in FIG. 1 cooperating with the shield members 101, 102, and 103 and the downstream member 40 of the cleaning device 38. The toner particles flying around in the casing 39 are sucked to the cooling fan 22 through the aforesaid throughgoing holes 83 and 84 and then through the elongated opening 44 formed in the rear plate and are recovered by the filter 80, while when the toner intercepted by the dowstream and upstream members 40 and 41 are to be recovered at the developing device 25, the upward displacement of the downstream and upstream members 40 and 41 hardly results in contaminating the equipment around the photoreceptor drum including the charging device.

As has been described so far, according to the present invention, two members are provided for intercepting residual toner particles on the photoreceptor and their slide contact pressures on the photoreceptor can be independently determined; thus, the photoreceptor can be cleaned by positively intercepting residual toner particles without shortening the life of the photoreceptor.

This invention is not limited to the embodiment described above and it is to be understood that changes and modifications may be made without departing from the scope of the invention.

What is claimed is:

1. In a cleaning device for use with a transfer type electrostatic copying machine, a wiping assembly disposed upstream of a charging-purpose corona discharger along the direction of travel of a photoreceptor to be brought into sliding contact with the photoreceptor during exposure to intercept residual toner particles on the photoreceptor, said wiping assembly comprising upstream and downstream members adapted to be brought into sliding contact with the photoreceptor, and pressure setting means for applying a first preset sliding contact pressure to the upstream member and a second, higher preset sliding contact pressure to the downstream member and for separating the upstream member and the downstream member from the photoreceptor during non-exposure to permit carrying of the intercepted residual toner particles to a developing device by movement of the photoreceptor, said pressure setting means including:

a casing, a first arm having a first end and a second end, a second arm having a first end and a second end and partially enclosing the first arm, a first spring connecting the first end of the first arm to the first end of the second arm, a pin fixed to the casing, the second end of the first arm pivotally connected to the pin to pivotally support the first arm on the casing, the second arm pivotally supported on the pin at a point intermediate the second arm first and second ends, a first swing lever, having a first end and a second end, a first rotary shaft extending parallel to an axis of the photoreceptor and coupling the upstream member to the first end of the first swing lever, a second swing lever having a first end and a second end, a second rotary shaft extending parallel to the axis of the photoreceptor and coupling the downstream member to the first end of the second swing lever, a second spring connecting the second end of the second swing lever to the second end of the first swing lever, a third spring connecting the second end of the second swing lever to the casing, a control member fixed to the first end of the first arm and positioned between the second ends of the first and second swing levers, and actuating means operative during exposure to push down the second end of the second arm and during non-exposure to move the second end of the second arm upwardly, whereby during exposure, the second end of the second arm moves down to pull up the second spring and the control member which pushes up the second end of the second swing lever to bring the downstream member into sliding contact with the photoreceptor, presetting sliding contact pressure of the downstream member on the photoreceptor, and the second spring pulls up the second end of the first swing lever to bring the upstream member into sliding contact with the photoreceptor, presetting sliding contact pressure of the upstream member on the photoreceptor, and during non-exposure the second end of the second arm moves upwardly freeing the control member from the second end of the second swing lever and the third spring pulls the second end of the second swing lever down to raise the downstream member, separating the downstream member from the photoreceptor, and the control member pushes down the second end of the first swing member to raise the upstream member, separating the upstream member from the photoreceptor.

2. A cleaning device for use with transfer type electrostatic copying machines as set forth in claim 1, wherein the thickness of the upstream member is less than the thickness of the downstream member.

3. A cleaning device for use with transfer type electrostatic copying machines as set forth in claim 1, further characterized by means defining an air exhaust passage, and a filter installed in the air exhaust passage, for producing a negative pressure in a residual toner intercepting section.

4. A cleaning device for use with transfer type electrostatic copying machines as set forth in claim 1, further characterized by magnetic attraction means positioned in a predetermined relation with respect to at least one of the downstream and upstream members.

* * * * *